US007204657B2

(12) United States Patent
Jackson

(10) Patent No.: US 7,204,657 B2
(45) Date of Patent: Apr. 17, 2007

(54) LIGHTWEIGHT SELF-LEVELING AUTOMATIC SCREED APPARATUS

(76) Inventor: Gerald Mclain Jackson, 4210 Jennings Rd., Lake City, MI (US) 49651-9375

( * ) Notice: Subject to any disclaimer, the term of this patent is extended or adjusted under 35 U.S.C. 154(b) by 264 days.

(21) Appl. No.: 11/085,492

(22) Filed: Mar. 21, 2005

(65) Prior Publication Data

US 2005/0207843 A1 Sep. 22, 2005

Related U.S. Application Data

(60) Provisional application No. 60/555,497, filed on Mar. 22, 2004.

(51) Int. Cl.
*E01C 19/00* (2006.01)
*E01C 19/22* (2006.01)

(52) U.S. Cl. ..... 404/85; 404/84.5; 404/84.8; 404/118

(58) Field of Classification Search ..... 404/85, 404/106, 110, 114, 116
See application file for complete search history.

(56) References Cited

U.S. PATENT DOCUMENTS 3,970,405 A * 7/1976 Swisher et al. ..... 404/105
5,871,302 A * 2/1999 Carlson ..... 404/96
6,976,805 B2 * 12/2005 Quenzi et al. ..... 404/114
7,121,762 B2 * 10/2006 Quenzi et al. ..... 404/84.1
2005/0163565 A1 * 7/2005 Quenzi et al. ..... 404/84.1

* cited by examiner

*Primary Examiner*—Raymond W Addie

(57) ABSTRACT

A lightweight one man screed apparatus to automatically strike off and level uncured concrete flatwork, includes a tri-pod framework beneath which a cutting/leveling member operates. The apparatus is controlled by two grade setting devices, adjustably mounted to the screed tool, which may be adjusted relative to a laser plane generating system. Physical control of the screed member may be provided by at least one screed tool pivotal arm assembly moved for and aft by a carriage operated under the tri-pod framework within a fore and aft footprint. The screed tool is adjusted to grade by being raised or lowered by at least one linear actuators responding to an electronic controller. When moving the framework and screed assembly into freshly poured concrete, an operator is assisted by retractable wheels. The wheels are rotationally stowable or used deployed as part of the tripod/transport system facilitating mobility.

18 Claims, 7 Drawing Sheets

LIGHTWEIGHT SELF-LEVELING AUTOMATIC SCREED APPARATUS

CROSS REFERENCE TO RELATED APPLICATIONS

This application claims priority of Provisional Patent Application Ser. No. 60-555,497, filed on Mar. 22, 2004.

BACKGROUND OF THE INVENTION

The present invention relates generally to a screeding device for uncured concrete floors and surfaces and more particularly to a lightweight self leveling automatic screed apparatus which may be easily transported, easily knocked down and reassembled, and used by one person or a small crew. The lightweight screeding device of the present invention is particularly suited for over ground sites as well as any site requiring portability of the screed apparatus such as elevated or basement floors, driveways, or slabs to be placed by small crews and/or minimally experienced personnel.

BACKGROUND OF THE INVENTION

Concrete screeds are used by personnel in the building industry to place and level uncured concrete to form a slab or floor. In its most simplistic form, a straightedge such as wooden 2"×4" is pulled back and forth across the uncured concrete by one or more persons to level the concrete to a predetermined grade which has been previously determined and set using such methods as stakes, wet pads or metal tubing on supports. This manual screeding method requires skilled, physically capable personnel to achieve a quality floor or slab.

More recently different types of sophisticated screeds have been developed to obtain a more consistently level concrete surface using lasers to meet stricter standards of today's building industry. Large, self propelled, laser screeds such as developed by Somero et al., U.S. Pat. No. 4,655,633, are useful for placing huge easily accessible floors, but are not easily portable or useful on smaller floors. Similarly, truss screeds such as Morrison's U.S. Pat. No. 4,806,047, are more adaptable to use on very large jobs.

At the other end of the modern screed continuum are the hand held vibratory screeds, such as U.S. Pat. No. 5,676,489, and U.S. Pat. No. 5,540,519 which work well on smaller jobs and are readily portable, but rely on operator skill to achieve consistency of the finished product, even when grade is laser established. By simply tilting the screed apparatus during placement of the concrete, the result may be deflections and variations in the levelness of the concrete both horizontally and vertically to the operator.

In light of the prior art, a need still exists for a relatively inexpensive, lightweight, easily portable screed, which does not rely on operator experience and skill to achieve an on grade level floor.

BRIEF SUMMARY OF THE INVENTION

It is the object of this invention to provide an apparatus for screeding/striking off concrete with laser accuracy, automatic mechanical means and ease of portability, in which the entire concrete screed process is performed automatically and accurately with minimal assistance from the operator.

The present invention establishes grade from a laser plane, employs a tri-pod supported framework, which adjusts for grade by means of linear actuators and strikes the concrete off using a screed member directed by a programmed control circuit, and controlled mechanically by attachment arms connected to a fore and aft movable carriage operating under the tri-pod frame means which has been placed into the freshly poured concrete, and is movable on the job using tires with which it may be placed into the concrete. The tires may then be stowed during the actual screeding until they are once again unstowed for moving to the next area. The screed apparatus may be knocked down and reassembled for further ease of transport in the bed of a pick-up or small trailer.

The tripod stance of the present invention provides a lightweight frame which may easily be placed into the fresh concrete, providing a platform from which the screed means may operate to strike off the concrete, with minimal obstruction of the work area, unlike prior art which typically is screeded with the screed means at least partially supported on the fresh concrete. In the present invention the screed means is supported entirely by it's tripod framework, placed into and over the uncured freshly placed concrete.

Further, the at least three actuator legs, of the present invention, in a triangular stance, advantageously permit maximum access for workers tending the concrete in the work area. The singular rear actuator, provides minimal structural obstruction.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a Lightweight Self-leveling Automatic Screed Apparatus comprising: an automatic height adjustable framework means, employing actuator means in three corresponding legs as the preferred embodiment, responding to a controller predetermined preprogrammed manner to planar establishment means, screeding automatically and repeating the method means until grade is achieved upon which apparatus shuts down, when the controller is satisfied. Further, an advantageous mode of transit consisting of two rotatably stowable wheels may be employed to manually transport the apparatus to its next screed area.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
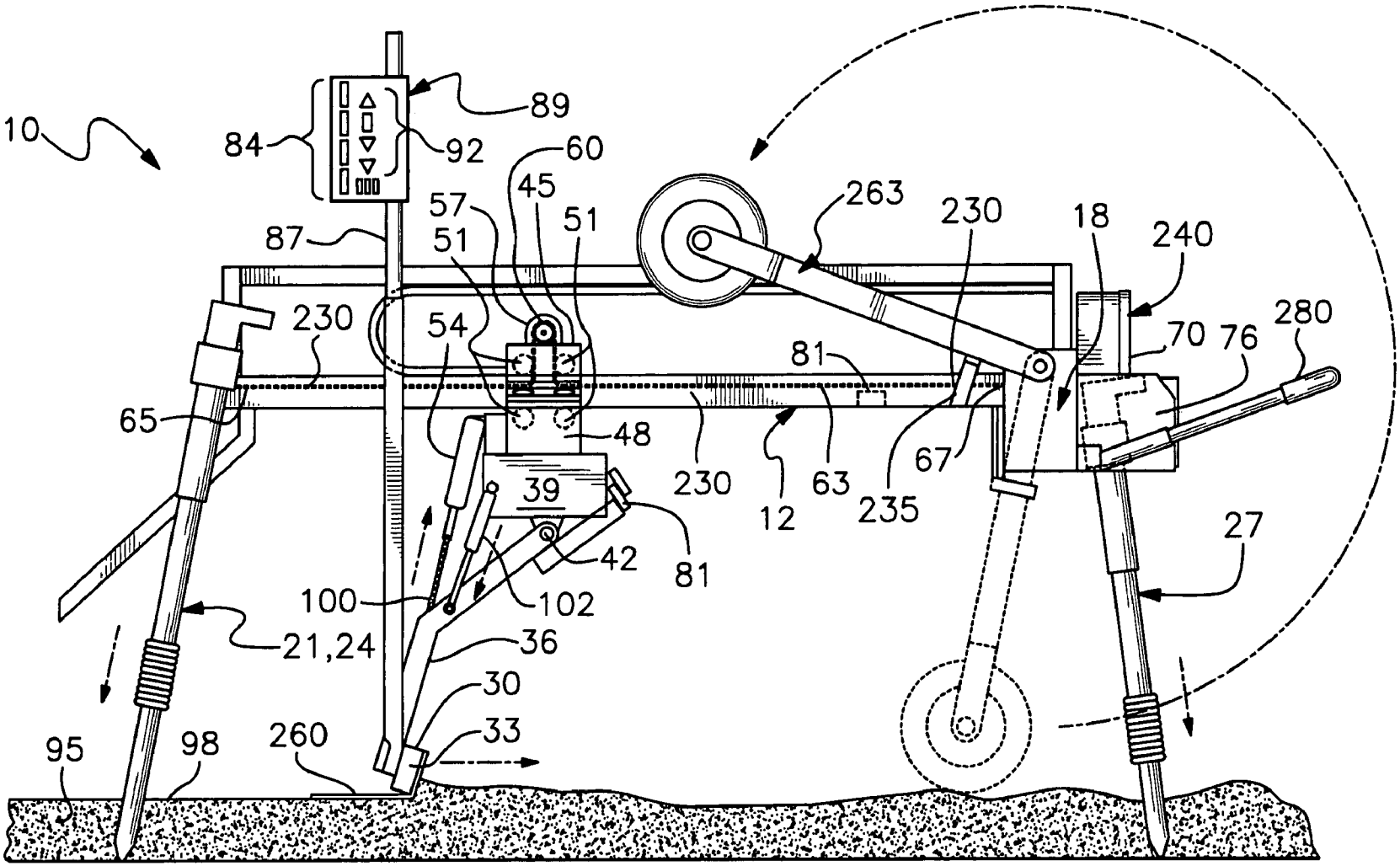
FIG. 1 is a side elevational view of the screeding device of the present invention illustrating retractable transport wheels and height adjustable support legs.

Turning now to the drawings, as discussed above, embodiments of the present invention relate to a portable automatic screed. FIG. 1 is a side plan view of the portable automatic screed 10 in accordance with the present invention. As shown the portable automatic screed 10 has at least one fore and aft track formed of one or more fore and aft extending beams 12. The fore and aft extending beams 12 are connected to each other in a front thereby a cross bar 15, and in the rear thereof a rear cross bar beam or channel 18. The front aft rear cross bars 15, 18 and the fore and aft beams 12 are supported by at least three leveling actuators 21,24, and 27, in the preferred embodiment being linear actuators. As shown, the front leveling actuators 21 and 24 are canted slightly forwardly and downwardly and the rear leveling actuator 27 is canted slightly rearward and downwardly. This configuration advantageously provides greater stability and permits a screed tool to have a greater range of motion for the screed means as described below.

As may be appreciated, the leveling actuators 21,24, and 27 and the fore and aft beams 12 provide a tripod frame on which the screed tool 30 may be movably supported. As shown in FIG. 1, the screed tool 30 may comprise a hollow tubular beam 33 supported by a pivotal arm assembly 36 and a carriage 39 by a rotational shaft 42, for example. While the screed tool is shown extending longitudinally perpendicular to the fore and aft direction, other transversely extending configurations are also considered to be within the spirit and scope of the present invention. The carriage, in turn is supported on the for and aft extending beams 12 by a plurality of brackets 45,48. These brackets adjustably support elastomeric rollers 51 that rollably engage a plurality of sides of the fore and aft extending beams 12. Thus the brackets 45,48, the carriage 39, the arm assembly 36 and the screed tool 30 are movably supported on the fore and aft extending beams 12 for movement in the fore and aft direction along the beams 12. Furthermore, a screed tool elevation actuator 54 provides for movement of the arm assembly; 36 in a generally up and down direction, albeit in an arc about the pivot shaft 42.

As shown in FIG. 1, a fore and aft screeding actuator 57 may be mounted on the carriage 39. As shown in FIG. 1, the screeding actuator 57 is provided in the form of an electric motor mounted to an upper surface if the carriage 39. This motor may be a stepping motor that is capable of precise control such as by pulse width modulation, for example. Alternatively, other motors could be used or other actuators could be incorporated, which may include without limitation linear actuators, lead screw driven actuators, hydraulic actuators, pneumatic actuators or actuators mounted to control attached wheels. Furthermore it is understood that the actuator 57 could be mounted on the frame that comprises the front and rear crossbars 15 and 18 without departing from the spirit and scope of the invention. However, as shown in FIG. 1, the actuator 57 may have a sprocket 60 that engages a chain 63 having a front end 65 fixed to the front cross bar 15 and the rear end 67 fixed to the rear cross bar 18. Thus, when the actuator 57 is activated, the sprocket 60 turns and holds the carriage 39 along the fore and aft extending beam 12 in either a forward or a rearward direction.

Figure 3:
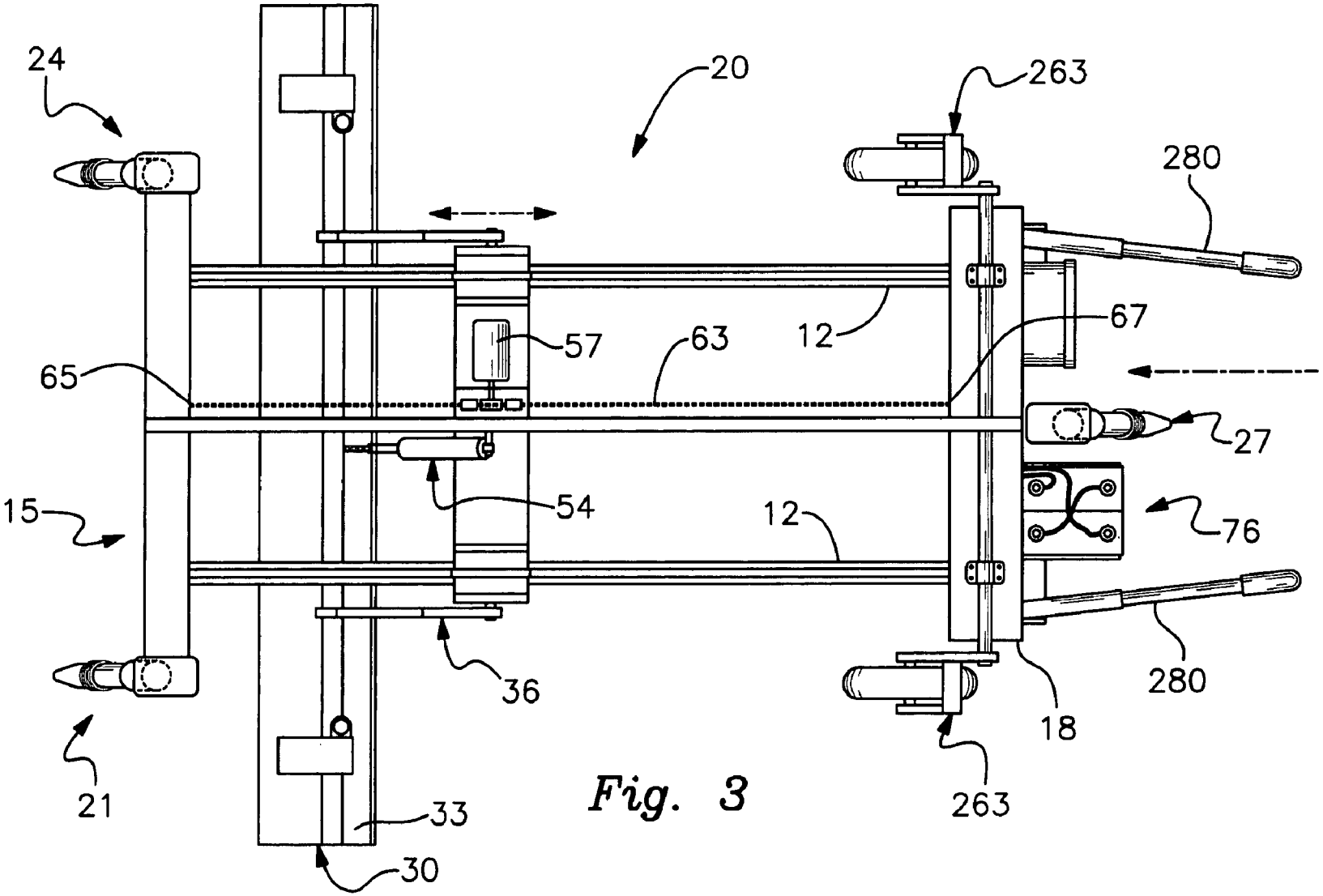
FIG. 3 is a plan view of the apparatus shown in *Fig.* 1; illustrating the linear motion of the carriage assembly.

As shown in FIGS. 1 and 3, an electronic controller 70 is supported on the rear cross bar 18. The electronic controller 70 has several switches on the exterior of a housing 73. The switches may include those shown and described with regard to FIGS. 1,3, and 5. Each of the actuators shown and described above and the electronic controller 70 are powered by the one or more batteries 76. These batteries may be two twelve volt gel cell batteries connected in a series, for example. Alternatively or additionally, the electrical components of the portable automatic screed may be powered by an alternating current source. Such an arrangement could include a transformer to convert the alternating current to direct current for example. As may be appreciated from FIG. 1, during operation, the electronic controller 70 receives signals from any number of sensors. These sensors may include but are not limited to, mercury switches 81 and photo electric cells 84. As shown, the sensors 84 are mounted on the height adjustable masts 87 that are mounted to the screed tool 30. As may be appreciated, the photo electric cells sensors 84 are part of at least two laser receivers 89 mounted on respective height adjustable masts 87. The receivers 89 detect a position at which the laser beam strikes the receiver 89 and indicates a needed adjustment by way of lights 92. This enables the user to manually adjust the height of the receivers 89 and to level the screed tool 30. Once the screed tool 30 has been leveled and the receivers 89 have been positioned at equal heights, the receivers 89 can be reset to a null value. Thereafter, a signal indicating any variation from the null value is sent back to the electronic controller 70. The electronic controller is configured to process this signal and in turn actuate any or all of the actuators to automatically provide the originally selected level. Thus, when the ground varies in elevation, or when one of the leveling actuators sinks into the soft ground the screed tool may still be kept at the preselected height and grade based on the independent standard of the laser. It is to be understood that the present invention advantageously levels the frame based on feedback from the laser. This ensures that the screed tool 30 is urged downwardly to the preselected height and grade. Advantageously if the screed moves to a position below grade, the fore and aft screeding actuator is turned off by the controller, until the below grade situation is corrected and the leveling actuators cause the screed to come back to the preselected height and grade, unlike prior art which relies on its operator to determine that the screed may be below grade.

It is understood that the screed tool could be set at a level having a predetermined slope with the laser receivers 89 still indicating a null. In this way a user can selectively vary grade of concrete 95 for all or part of a slab or floor to be poured and finished. Similarly, in another embodiment mercury switches 81 can be operatively connected to the electronic controller 70 to provide feedback as to whether the frame is level or not. In the embodiment shown in FIG. 1, the photo electronic sensors 84 detect variation in a side to side direction while the mercury switches 81 detect variation in the level in the fore and aft direction. However, in another embodiment both side to side and fore and aft leveling means could be provided by mercury switches or by providing an additional laser receiver spaced rearwardly from those shown in FIG. 1, a fore and aft level could be detected and transmitted purely by photo electric sensors 84.

The electronic controller 70 is configured to either automatically or in response to manual activation of particular switches, activate each of the actuators 21,24,27,54, and 57. The manner in which this actuation occurs automatically or by active input will be described in greater detail below. However, it should be noted here that the portable automatic screed of the present invention advantageously, automatically pulls the screed tool 30 across a bed of freshly poured concrete 95 in a work area that underlies the frame 20. Access to the work area is improved over prior art by having only a single leveling actuator 27 at the rear of the screed 10. The screed 10 performs and repeats this action for any number of runs needed to bring the upper surface 98 of the concrete 95 to the initially set level on grade condition. As may be appreciated, there are cases in which the poured concrete will be stacked higher than can be leveled in a single run. Therefore it is necessary to permit the arm assembly 36 to be looped upwardly without backdriving the linear actuator 54. To this end a flexible connection such as chain 100 may be provided between the linear actuator 54 and the arm assembly 36. Furthermore, gas shock 102 may be provided to bias the screed tool 30 in a downward direction. The stiffness of the gas shock 102 may be selected to be less than the combination of weight and actuation forces that will be experienced at the connection point on the arm assembly 36. Thus, if the concrete 95 is too stiff, or is stacked too high for the screed 10 to bring the upper surface 98 to the predetermined level, then additional passes may be automatically provided to compensate.

Figure 6:
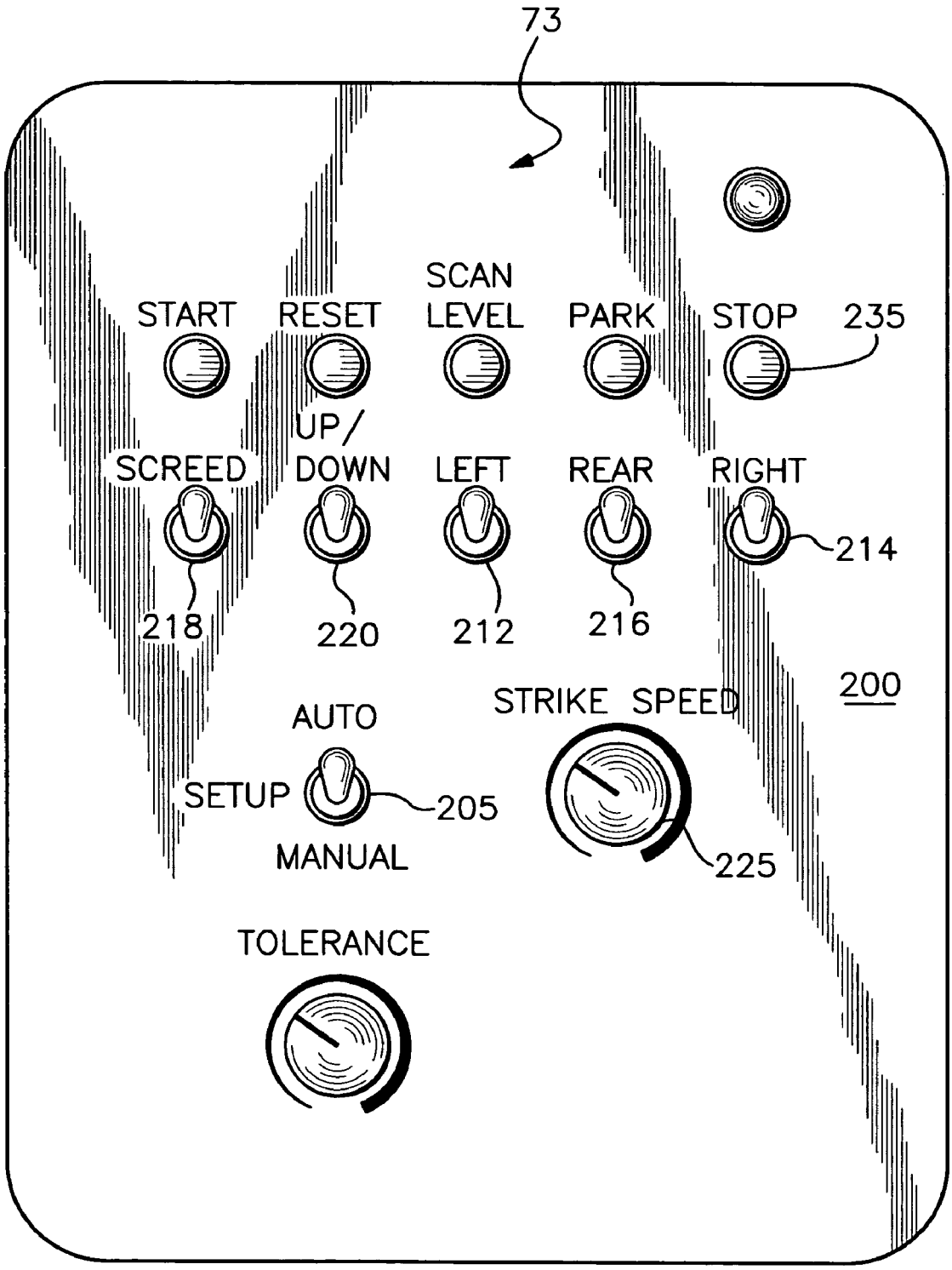
FIG. 6 is an exemplary illustration of a control panel 73.

With regard to FIG. 6, a rear panel 200 of the electronic controller 70 is shown. Several exemplary switches are shown including a manual/automatic mode switch 205. It is to be understood, that this switch 205 may be a three position switch, having an "off" position intermediate the manual position and automatic position. Alternatively a separate on/off switch 210 may be provided. Leveling actuator switches 212, 214, and 216 may be provided for activating each of the leveling actuators in "up" and "down" directions. These switches may also have a stationary center position. A fore and aft screeding switch 218 may be activated to move the carriage arm assembly and screed tool forwardly and rearwardly. Similarly, a screed tool elevation switch 220 may be activated to move the screed tool and arm assembly up and down. Additionally, a speed control switch 225 may be provided. The switch 225 may be in the form of a rheostat that modulates pulse width, for example.

Figure 5:
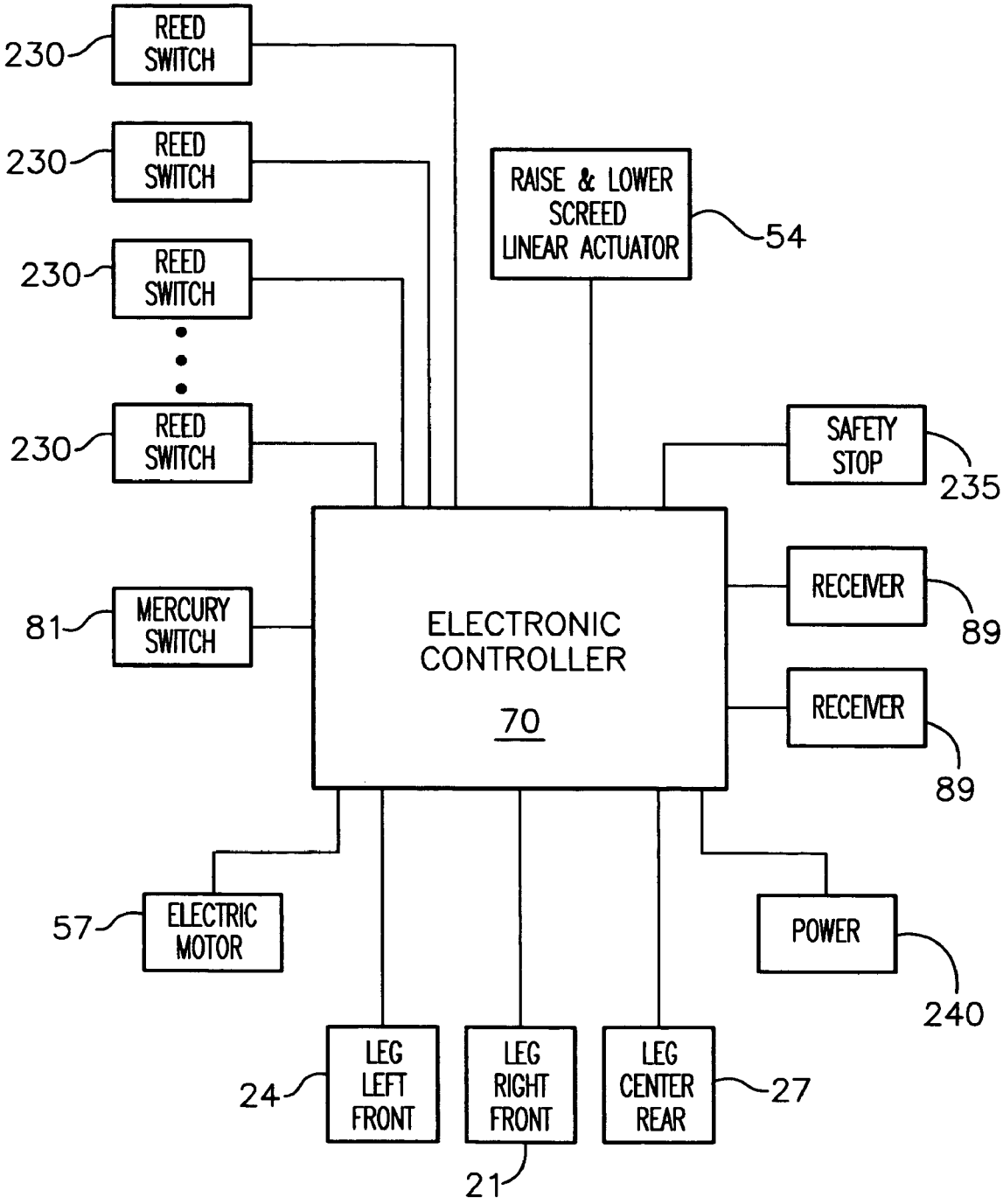
FIG. 5 is a block diagram of the electronic controller 70 and its various peripherals.

FIG. 5 is a schematic diagram showing various elements of the portable automatic screed that have electrical components operatively connected to and/or controlled by the electronic controller 70. Some of the elements of the screed that are connected to the electronic controller 70 simply provide feedback. For example, position sensors 230 may be positioned along the fore and aft beams 12 to sense and relay a signal to the controller 70 regarding a position of the carriage along the track. These position sensors may be any of a variety of switches including reed switches, micro switches, photo electric cells, or sonic sensors. A corresponding physical characteristic would need to be provided on the carriage for sensing by means of sensors 230. For example, with reed sensors, a magnet may be located in the carriage or bracket supporting the wheels so that when the carriage approaches a respective sensor, the sensor is activated. Some or all of the position sensors 230 may be eliminated when the screeding actuator is a stepping motor that counts revolutions, for example. With this arrangement, the exact position of the carriage would be indicated by the number of revolutions, for example. Another element that is not controlled by electronic controller is a safety stop switch or sensor 235. The switch or sensor 235 may be of the type described above with regard to position sensors 230. However the safety stop switch or sensor 235 is positioned to stop the carriage, arm assembly and screed tool before they engage other components of the portable automatic screed 10. For example. if the arm assembly 36 were to contact the safety arm shown in FIG. 1, the safety stop switch or sensor 235 would be automatically activated. In response a signal would be sent to the electronic controller 70 and the motor 57 would be stopped. Slowing and stopping the motor may be accomplished in accordance with a predetermined pattern by the electronic controller. This may be achieved by pulse width modulation of the motor for example. As described above, power 240 may be supplied to the electronic controller 70 by two twelve volt gel cell batteries 76, for example. Power may be supplied to the various elements of the screed via the electronic controller and/or directly to components. Alternatively, a power cord could be extended from the screed to a 120 volt power source.

As shown in FIG. 5, the leveling actuators 21, 24, and 27 are connected to the electronic controller 70. Likewise the screed tool elevation actuator 54 is also connected to the electronic controller 70. The screeding actuator 57 is also connected to the electronic controller. One or more mercury switches 81 may be connected to the electronic controller. Laser receivers 89 may be connected to the electronic controller as described above. Thus the electronic controller provides an integrated system that may be operated in an automatic mode, or actively controlled via switches as described above, in the manual mode.

While the present invention has been shown and described with regard to specific embodiments above, it is to be understood that a similar automatic screed could be provided with only two automatic leveling actuators in cases where the ground is substantially level. That is with two automatic leveling actuators and a third non-automatic leg, both side to side and fore and aft leveling could be effectuated under the control of an electronic controller. On the other hand, three automatic leveling actuators as described above advantageously enables a more sophisticated leveling protocol by way of example, and not by way of limitation. The tri-pod stance also uniquely and advantageously provides unobstructed work area for the placement workers.

Figure 7:
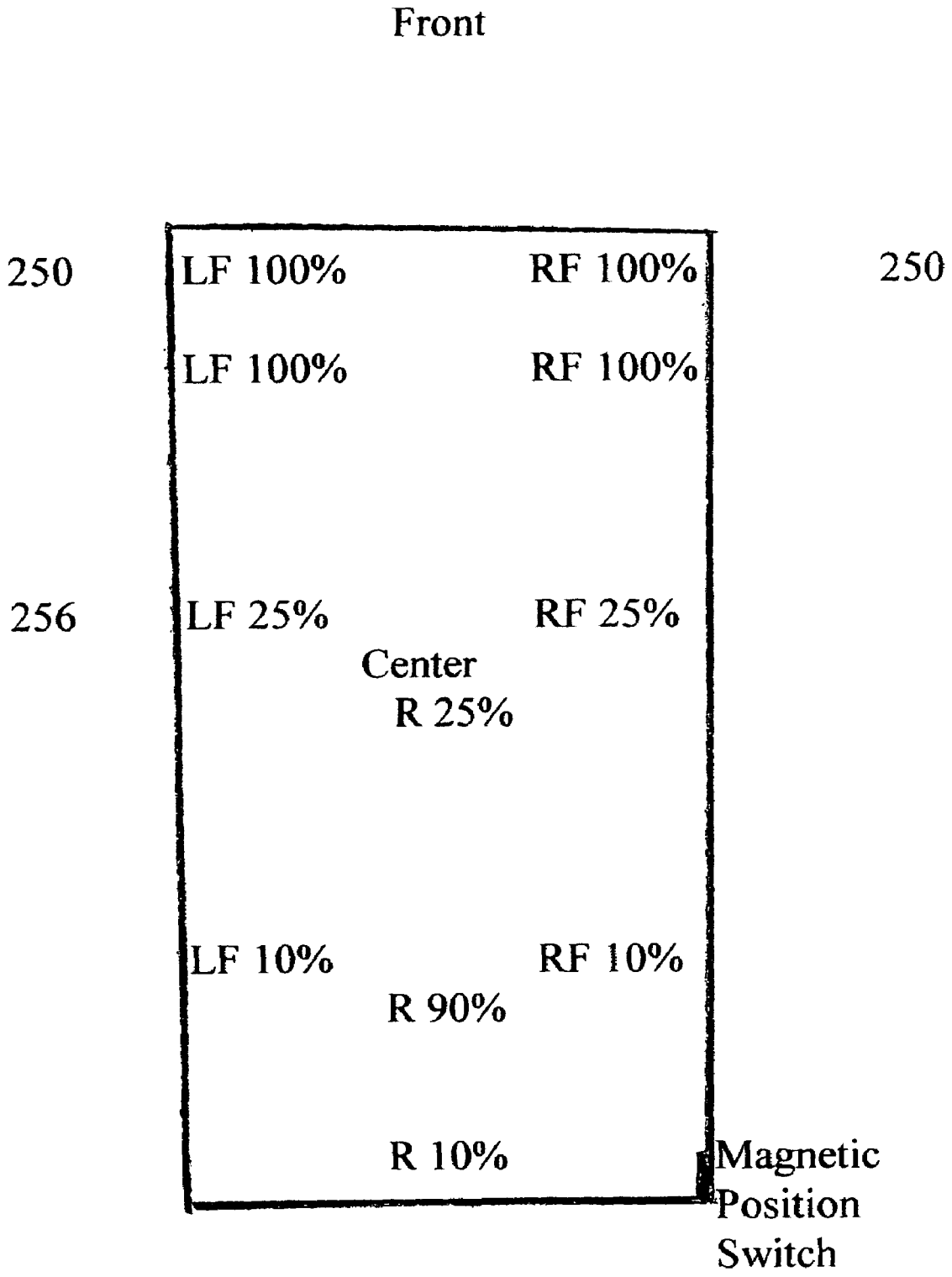
FIG. 7 is a schematic illustration of present ratios for elevation change relative to the support legs.

FIG. 7 shows a diagrammatic view of an area generally corresponding to that which is swept out in a run by the screed tool of the present invention. Elements 250 correspond generally to the placement of the forward leveling actuators 15 in FIGS. 1 through 3.

Elements 253 corresponds generally to the placement of the rear leveling actuator 18. The run area 256 is depicted by a rectangle. As shown, the left front and right front actuators are run at a maximum speed when the carriage and screed tool is in a forward position. The speed of the front leveling actuators is reduced generally proportional to a distance traveled in the rearward direction by the carriage and screed tool. As shown the left and right front leveling actuators are run at approximately 25 percent of its maximum speed when the carriage reaches a generally central position in the fore and aft direction along the tracks. At the same time, the rear leveling actuator is run at approximately 75 percent of its maximum speed when the carriage is at the central position. When the carriage is approximately ¾ of the fore and aft distance of a complete run back from the forward position, the front leveling actuators are run at approximately 10 percent of the maximum speed while the rear leveling actuator is run at 90 percent of its maximum speed. Alternatively, a protocol may be devised in which the percentages shown in FIG. 7 represent the extent to which the front and rear leveling actuator account for leveling when the carriage and screed tool are at respective fore and aft positions. The speed variations may be provided by pulse width modulation under electronic control for example. This kind of dynamic control is extremely advantageous in a system in which the force dynamics are constantly changing. Furthermore, actuating the leveling actuators nearest the screed tool at higher percentages will provide a more direct response in vertical movement. With this kind of dynamic control greater precision in leveling concrete is made possible even with a relatively light weight portable automatic screed.

It is to be understood that while the invention has been shown and described as having three leveling actuators or legs, it is possible to provide the present invention with four or more such leveling actuator components. However, the complexity of such a device would increase with each added leveling actuator. On the other hand, replacing the single rear leveling actuator 18 by a pair of leveling actuators is well with in the spirit and scope of the present invention, especially if the pair of rear leveling actuators are placed close together.

Figure 2:
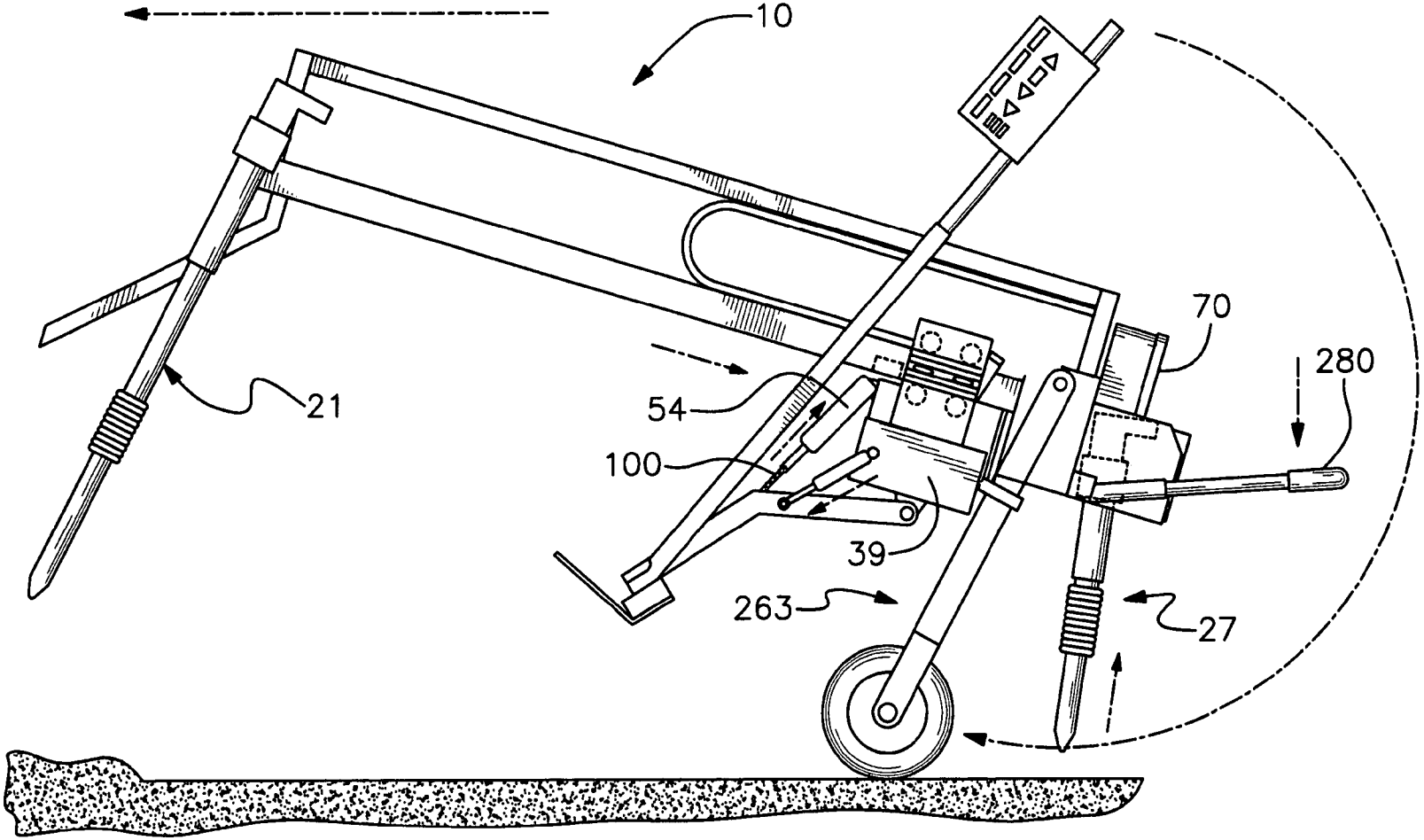
FIG. 2 is a side elevational view of the apparatus shown in FIG. 1, with the retractable legs rotated into a transport position.

As shown in FIGS. 1, 2, and 3, the leveling actuators 21, 24, and 27 are canted outwardly and downwardly from the frame 20 in the fore and aft direction. The angle at which the leveling actuators 21, 24, and 27 are canted in the fore and aft direction may be approximately one hundred ten degrees relative to the fore and aft extending beam 12. This angle may be varied without departing form the spirit and scope of the invention. In particular, this angle is intended to approximately match the angle at which the screed tool beam 33 will be disposed during screeding. Thus, the canted angle of the leveling actuators 21 and 24 advantageously reduces the tendency for the screed tool 30 to contact and/or damage the front leveling actuators 21 and 24. Furthermore, the canted angle provides greater stability to the portable automatic screed 10. The front leveling actuators 21 and 24 are also canted outwardly and downwardly in a side to side direction for greater stability. Canting the leveling actuators outwardly and downwardly has the added advantage of dampening of vibration during the operation of the screed.

When the screed tool is caused to move rearwardly in a sweep that engages poured concrete, the reactive forces tend to push the frame and leveling actuators 21,24, and 27 forwardly. However, the canted angle of the leveling actuators 21, 24, and 27 tend to cause the lower ends of the leveling actuators to pierce the subgrade instead of sliding horizontally. Furthermore, lower ends may be provided with cleat structure to frictionally grip the ground, when the subgrade is hard.

As shown in FIG. 1, the screed tool beam 33 may be angled at approximately one hundred and ten degrees. Providing the screed tool beam 33 at this angle has the advantage of engaging the concrete 95 more aggressively. However, screeding with the screed tool beam 33 alone disposed at such an angle also tends to leave rocks exposed on the surface 98 of the screeded concrete 95. In order to avoid this problem while implementing the more aggressive engagement, a trowel plate 260 may be provided as part of the tool. The trowel plate 260 is fixed to or integral with the screed tool 33, and extends under and rearwardly of the screed tool 33 in a generally horizontal direction. Thus the trowel plate 260 is disposed generally at one hundred and ten degrees relative to a rear face of the screed tool 30. Another advantage of the trowel plate is that it extends the working reach of the screed tool 30 in a forward direction. For example, the trowel plate 260 of the screed tool 30 can be made to nearly engage the front leveling actuators 21 and 24. Alternatively, the trowel plate 260 could be notched to generally surround the front leveling actuators 21 and 24 in a forward most position at the beginning of a run. Thus, the portable automatic screed of the present invention may screed substantially to a wall disposed in front of screed 10.

Another advantage of the portable automatic screed of the present invention is that after the screed has been wheeled to the position of a run, the wheels 263 and the wheel arms 266 are rotated up and out of the work area by a manual wheel handle, for example. Thus, the wheels 263 and the wheel arms 266, are out of the way of the workers tending to the concrete and operating screed 10.

As shown in FIGS. 1 and 2, the elastomeric rollers 51 advantageously surround and engage the fore and aft extending beam 12 to provide rolling movement of the carriage 39 and the screed tool 30 there along. As shown in FIG. 1, the upper brackets 45 and the lower brackets 48 support the elastomeric rollers 51 in a surrounding relation with respect to the fore and aft extending beam 12. The rollers may be supported on the brackets 45, 48 by respective eccentrics, thus, the position of the rollers may be adjusted until the rollers 51 engage the fore and aft extending beam 12, at which position, the eccentrics may be tightened. FIG. 1 shows lower portions of bracket 48 extending upwardly from the carriage 39 and having eccentrics and axles supporting elastomeric rollers 51.

The elastomeric rollers 51 may advantageously comprise a resilient material surrounding a ball bearing or other friction reducing device. The material of the elastomeric rollers 51 may include rubber, polyurethane,nylon, or a composite material. Wheels similar to roller blade wheels provide a dampening advantage in which the side to side and up and down vibrations are reduced. Furthermore, having a pair of wheels supported on each flange of the bracket 45/48 also enhances the dampening effect. The result is that the vibrations experienced by the laser receiver 89 is lessened. Wheels of such make-up and in this configuration also provide the advantage of enabling rolling travel of the elastomeric rollers 51 over contaminated surfaces of the for and aft extending beam 12 without significant decreases in performance in most cases. In lieu of the wheeled movement of the carriage, linear slides might be employed within the spirit and scope of the present invention.

The present invention may include vibration of all or part of the screed to improve finishing characteristics of the concrete 95, for example. Furthermore, if any of the actuators are implemented as hydraulic actuators, providing vibration in the system may improve functionality in starting and stopping actuation.

The frame of the screed is constructed so that the transport tire and wheels 263 are only slightly rearward of a center of gravity for the overall screed 10 when the carriage is in a rearmost position. Thus an operator need only apply a small downward force as indicated by 277 on the transport handles 280, which are fixed to the rear cross bar 18, in order to lift a front end of the frame 20 as shown in FIG. 1. Continuing to apply the small downward force, the operator can move the screed 10 supported on the transport wheels 263 in a deployed position shown in dashed lines in FIG. 1. Continuing to apply the small downward force, the operator can move the screed 10 supported on the transport wheels 263 in a deployed position shown dashed lines in FIG. 1. Moving the screed 10 may require similar force and be approximately as simple as would be moving a wheel barrow, for example. Thus, moving the screed into and out of a position for striking of a screed section is relatively easy. Furthermore, moving the screed over wet concrete is also possible, when necessary. The lightweight, easily moveable screeding apparatus of this invention, with its stowable wheels, is an improvement over prior art in that the apparatus may be moved easily by one person without the aid of heavy motor means, or the aid of heavy transportation means, which in prior art are seen obstructing the work area.

The screed of the present invention may be made to have any number of dimensions. However, in one particular embodiment of the invention, the frame 20 may be located approximately thirty-six inches above the ground or subbase. The frame may have a width of approximately thirty-six inches, a fore and aft length of approximately seventy-two inches and may be formed of a tubular material such as aluminum or composites to reduce weight. The fore and aft screeding actuator means 57, may be a one-third horse power motor at approximately two hundred seventy pounds of pulling capacity at the radius of the output sprocket. The leveling actuators 21, 24 and 27 and the screed tool elevation actuator 57 may be provided as linear actuators that employ a lead screw that is turned at at high rate of speed to move one portion of the actuator relative to another and thus lengthen or shorten the actuator. The frame 20, arm assembly 36, and the actuators 21, 24, 27 can be easily dismantled and stored or hauled in a pickup truck for example, Furthermore, the screed 10 can be easily carried through doorways in a disassembled state and put back together inside a building in which concrete is to be poured and finished. The frame members may be separately connected to each other by way of sockets and inserts on respective members, for example. Thus even the frame can be knocked down into separate components for storage and/or transport, by separating frame, carriage, and transport wheel assembly.

A method of using a portable automatic screed in accordance with the present invention includes the following steps. Initially, a laser is positioned in accordance with a step 110 of FIG. 4. This laser may be of a type that sends out a laser beam in a level non-level plane in an arc of 360 degrees, for example. A non-level plane may be used for screeding a sloped surface. Lasers that send a beam in a shorter or a longer arc may also be implemented in accordance with the present invention. Typically, a laser would be mounted on a wall or supported on a tripod for a stable motionless condition. Next the portable automatic screed is raised and/or lowered to an appropriate level and grade as indicated at 115. With the screed tool at the appropriate level and grade, the laser receivers are adjusted to indicate level, as indicated at 120. Concrete is poured out on the subgrade to be covered as indicated at 125. Then the portable automatic screed is rolled into position for a screed run as indicated at 130. Steps 125 and 130 may be interchanged, depending on the availability of the machine and the concrete, as well as other logistical considerations. The portable screed of the present invention has the advantage of providing a center of gravity that is very; near a vertical plane through the travel wheels in their deployed position, Therefore, only minimal force by a user is required in order to keep the screed balanced during the movement from one run position to another. As may be appreciated, the portable screed may be transported similarly to moving a wheel barrow, for example. Furthermore the transport wheels and overall configuration of the portable screed facilitate traversal of soft soil or poured concrete, when needed. With the portable automatic screed in position, a user then switches the machine on and begins its operation as indicated at 135 FIG. 4.

In the automatic mode the portable automatic screed raises the screed tool and moves it to a forward position. The portable automatic screed then lowers the screed under electronic control, as indicated at 140. The screed the makes a path by moving the screed tool to the rear as indicated at 145. At the end of the path, the screed checks to see if the screed tool is on grade at the preselected level for the complete path as indicated at 150. If the screed tool was not on grade for the entire path, then the screed returns to the step indicated at 140 and prepares for and makes another pass. After the screed tool remains on grade at the predetermined level for the entire pass, the screed automatically goes into the park condition by raising the screed tool to a fully raised position and shutting off the controller as indicated at 155 in FIG. 3. At this point, the portable automatic screed has completed screeding for the work area under the frame 20. In accordance with the present invention, steps 125 through 155 may be repeated as many times as desired as indicated by loop shown in FIG. 4. If the portable automatic screed is to be used in a completely different site, or if a different level or grade is desired, then stops 110, 115, and 120 will be repeated as well.

With the electronic controller turned off, the operator manually rotates the tires from the stowed position into a deployed position, "park" position contacting the ground. By forcing the tires slightly past a vertical center, the wheel support arms will rotate into a locked position, as indicated at 126. In the park condition, the center of mass for the portable screed 10 is very near the center of the wheels. With the wheels in the "park" position, the operator can raise the rear leveling actuator in the manual mode, as indicated at 127. It is to be noted that the manual switches of the controller 70 can be made to override the automatic mode so that a user can adjust a level or turn off the screed at any time. With the tires in the locked position and the rear leveling actuator raised, the user applies minor downward force on the transport handles 280 to raise the front end of the portable automatic screed, as indicated at 128. Only minor force is required because the screed is configured to have its center of mass only slightly forward of transport wheels. Then the screed can be easily wheeled to the location of the next run while applying the downward force. In another embodiment of the present invention, the wheels might be self propelled.

Figure 4:
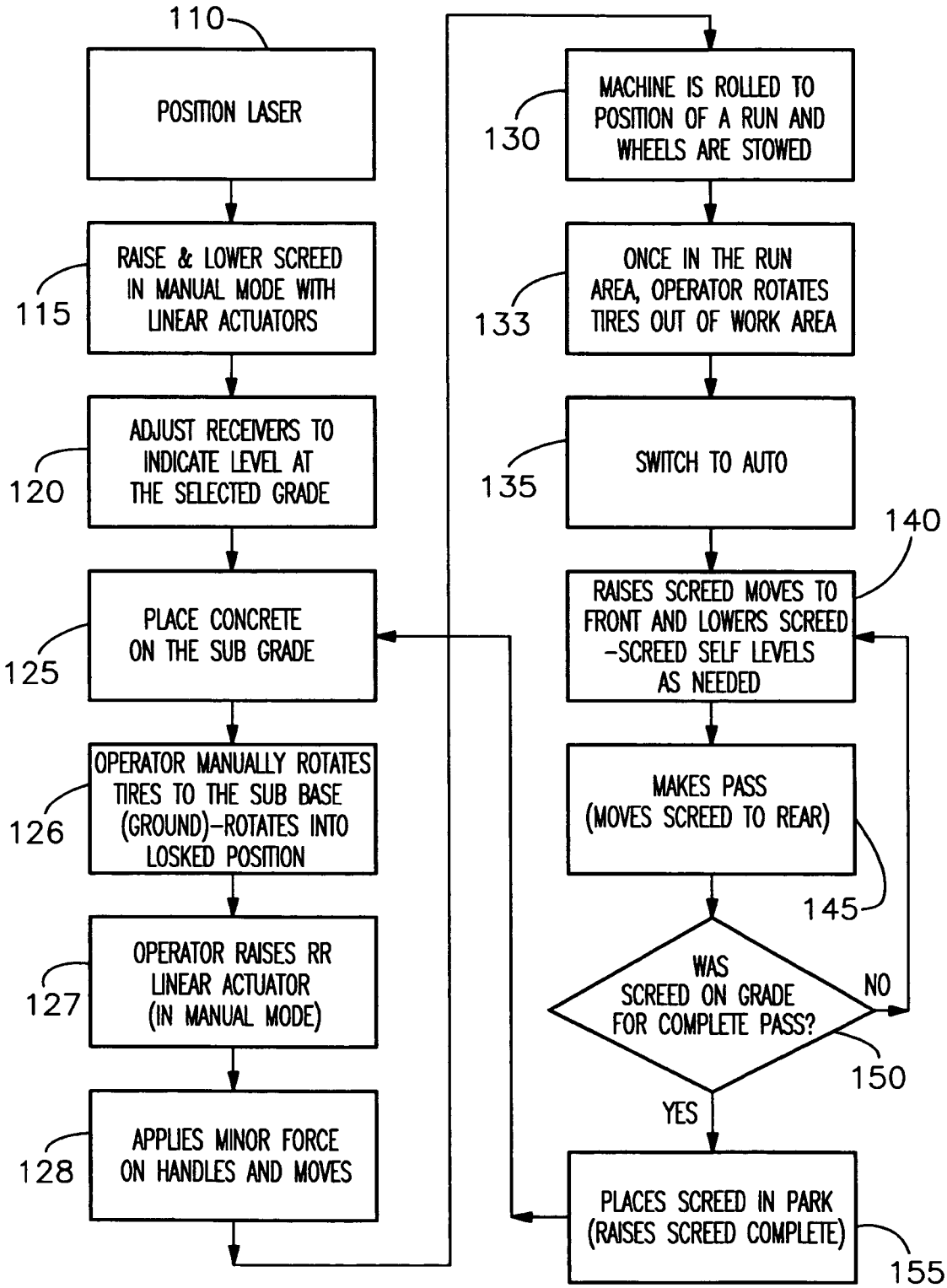
FIG. 4 is a schematic diagram of a method of operating the screeding device of the present invention.

Once the screed is in position for the next run, the operator rotates the tires out of the work area, as indicated at 133 in FIG. 4. It is to be noted that the screed self levels after each run and after each time the machine is moved to a new run area. In particular, when the rear leveling actuator has been raised, the screed self-actuates the rear leveling actuator until a mercury switch, for example indicates a level condition. Then the screed moves the screed tool to the forward position and begins striking in the repeat sequence described above.

It is to be noted that the portable automatic screed of the present invention could alternatively be configured to have the center of gravity located rearward of the center of the transport wheels when the screed is in the park condition. In this case a user would have to apply an upward force to the transport handles 280 to balance the screed and to keep it from tipping rearwardly during the transport from one location to another. In this case, instead of the rear leveling actuator being retracted, the front leveling actuators would need to be retracted and the self leveling would be primarily effectuated by actuation of the front leveling actuators. It is to be understood that with a center of mass located rearwardly of the center of the transport wheels, the portable screed would handle much more like a wheel barrow during transport. However this configuration may also require the user to support the screed for a period before the carriage reaches a rearmost position. Alternatively, the rear leveling actuator may be positioned so that it is always rearward of the center of gravity so that the user only needs to apply upward force when the rear leveling actuator is manually retracted. In any case, it is to be understood that only a minor force will be required to keep the screed balanced in the "park" position so that movement of the screed may be easily performed and is facilitated by rolling of the transport wheels.

The embodiments and examples set forth herein are presented in order to best explain the present invention and its practical application and to thereby enable those of ordinary skill in the art to make and use the invention. However, those of ordinary skill in the art will recognize that the foregoing description and examples have been presented for the purpose of illustration and example only. The description as set forth se not intended to be exhaustive or to limit the invention to the precise form disclosed. Many modifications and variations are possible in light of the teachings above without departing from the spirit and scope of the invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A lightweight self-leveling automatic screed apparatus for striking off and screeding uncured concrete the apparatus comprising:

a frame member with a tripod stance comprising at least three triangularly placed, automatically height adjustable legs attached to a polygonal frame;

a concrete surface screeding member comprising a fore and aft movable carriage system motively suspended from the frame member, the carriage system comprising a plurality of arms operatively associated with raising and lowering at least one screed tool, for striking and leveling the uncured concrete; and a controller programmed to automatically operate said screed apparatus, with reference to a laser generated plane.

2. The concrete screeding apparatus of claim 1 further comprising two level-type handles mounted to said frame member, and two transport wheels which are rotational around a horizontal axis, wherein the transport wheels are protractably positioned out of the work area when not deployed for transport.

3. The concrete screeding apparatus of claim 1, wherein a fore and aft distance between the forward legs and rear leg provides a fore and aft limits of a working footprint; and the or carriage assembly remains within the footprint.

4. The concrete screeding apparatus of claim 1, wherein said screed assembly further comprising at least one adjustable gas shock for downward pressure applied to the screed tool in the direction of the concrete.

5. The screed assembly of claim 4, wherein the at least one adjustable gas shock has a first end connected to the carriage assembly, and a second end connected to the screed tool assembly.

6. The concrete screeding apparatus of claim 1, wherein elastomeric rollers movably surround and engage a longitudinal frame member, thereby facilitating fire and aft motion of the screed tool, while dampening vibrations experienced by the screed tool and carriage assembly.

7. The concrete screeding apparatus of claim 1, comprising at least two proximity sensors supported on the frame.

8. The concrete screeding apparatus of claim 1, wherein apparatus can be separated into component parts.

9. A method for striking off an unfinished concrete surface using a lightweight self leveling automatic screed of claim 1, comprising the steps of;

deploying transport wheels from the stowed position to the deployed position;

manually guiding the screed apparatus, using the transport wheels, into a strike off position for adjusting the height and angle of the screed tool relative to a laser generated plane;

activating automatic operation, whereby a screed tool assembly begins a striking sequence under control of an electronic controller until achieving an ongrade leveling thing of said unfinished concrete moving the screed apparatus, and repositioning for next strike off sequence.

10. The method of claim 9, further comprising the preliminary step of pouring concrete on the subgrade prior to manually guiding the screed apparatus into said strike off position.

11. The method of claim 9, further comprising the step of a screed tool striking the concrete within the frame footprint, and automatically repeating the strikeoff sequence adjusting elevation and level of the screed tool.

12. The method of claim 11, further comprising the step of continuously sensing a height and angle of the screed tool relative to the laser plane.

13. The method of claim 11, further comprising the step of automatically adjusting the height and angle of the screed tool relative to the laser plane.

14. The method of claim 13, wherein the step of adjusting the screeding apparatus comprises adjusting a length of at least one leg of a plurality of legs.

15. The method of claim 11, wherein the screeding apparatus automatically shuts off when the screed tool remains substantially on grade for a complete pass, over the unfinished concrete being leveled.

16. The method of claim 9, further comprising retracting the transport wheels to their stowed position.

17. The method of claim 16, further comprising retracting the transport wheels from the deployed position, wherein the step of retracting comprises manually rotating the wheel support arm protractably.

18. The method of claim 9, further comprising providing the screeding apparatus with disassembly points, such that said screeding apparatus can be disassembled into component assemblies.

* * * * *